United States Patent [19]

Jones

[11] 4,130,223

[45] Dec. 19, 1978

[54] FEED LEVEL MONITOR AND CONTROL APPARATUS

[75] Inventor: Robert D. Jones, Oskaloosa, Iowa

[73] Assignee: Intraco, Inc., Oskaloosa, Iowa

[21] Appl. No.: 730,931

[22] Filed: Oct. 8, 1976

[51] Int. Cl.[2] ..... B07B 1/28

[52] U.S. Cl. ..... 222/55; 222/56; 222/231; 222/371; 198/524; 198/532; 209/245; 209/491

[58] Field of Search ..... 222/55, 56, 64, 231, 222/371; 198/502, 524, 532, 525; 209/245, 246, 491, 492

[56] References Cited

U.S. PATENT DOCUMENTS

| | | | |
|---|---|---|---|
| 1,460,573 | 7/1923 | Church et al. | 222/55 X |
| 2,758,700 | 8/1956 | Plumb | 198/525 |
| 3,198,386 | 8/1965 | Hartley | 222/55 |
| 3,227,232 | 1/1966 | Christmann | 198/502 X |
| 3,902,995 | 9/1975 | Jones et al. | 209/257 X |
| 3,971,714 | 7/1976 | Jones et al. | 209/257 |

*Primary Examiner*—Robert B. Reeves
*Assistant Examiner*—Frederick R. Handren
*Attorney, Agent, or Firm*—Henderson, Strom, Sturm, Cepican & Fix

[57] ABSTRACT

A hopper device for delivering granular or powdery material to a conveyor system of a type having a circuitous tube and a continuous flexible member having disc members rigidly attached thereto has a material level monitor and control apparatus attached thereto. The continuous flexible member passes through the hopper and a material flow varying mechanism is disposed within the hopper for causing material to be delivered from the hopper into the conveyor system when such mechanism is in operation. A housing having a chamber therein is attached to the outlet side of the hopper and has a float assembly disposed in the chamber for sensing the amount of material being fed into the conveyor system. A mechanism is furthermore provided for linking the operation of the mechanism for varying the amount of material delivered to the conveyor system in response to the movement of the sensing mechanism and float whereby when the conveyor system is running continuously, the conveyor tube will always be running full of material, but will never be overloaded.

12 Claims, 6 Drawing Figures

FEED LEVEL MONITOR AND CONTROL APPARATUS

BACKGROUND OF THE INVENTION

The present invention relates generally to conveyor systems, and more particularly to a conveyor device for monitoring the level of material in the conveyor system and for controlling this level automatically.

Conveyor systems in general have a problem of controlling the amount of material in the system. This is particularly a problem in closed conveyor systems, especially those closed conveyor systems having a continuous loop wherein some of the material being conveyed is eventually returned to the point of material input. If such conveyor becomes too full, overloading takes place, which can jam up the conveyor system and stop it altogether. On the other hand, if the system is empty, or is not running at full capacity, the efficiency thereof in terms of time and energy is diminished.

In certain types of poultry feeding installations, it has been found to be desirable to feed large numbers of poultry one large feeding at rather lengthy intervals between feedings, as opposed to smaller feedings at shorter intervals. Under such circumstances it has been determined that the poultry become so hungry that when the conveyor system is activated, such poultry will immediately run to the areas where the feed is concentrated. Under previous systems, a certain amount of feed would be fed to the poultry and the conveyor system would continue to run, dropping the feed at numerous outlets, until the feed is completely gone out of the conveyor tube. When the next feeding occurs, the system is again filled with feed, but the feed drops out of the openings closest to the point of feed inlet first, thereby causing the poultry to rush immediately to these feed openings, concentrating very large numbers of poultry in one area while all of the poultry are struggling to eat a very small quantity of feed. Of course, gradually the other feed outlet openings would deliver feed and the poultry would gradually move to those openings to eat, but during this initial frantic attempt to get to the first feed drop, many of the poultry can be and are injured.

In order to overcome the problem in the above paragraph, it has been determined that if the conveyor tube could be full of feed at the point in time when the conveyor system is activated, all of the feed outlet openings would deliver feed at the same time, thereby obviating the rush to the feed outlets near the point of feed inlet, and thereby preventing the poultry from injuring each other. Heretofore, however, it has not been possible, or at least not practical, to be able to fill the conveyor tube so as to achieve the desired result. Consequently, there is a need for a system which will allow a feed conveyor tube to be full of feed at all times without the danger of overloading the system and causing it to stop or break down.

SUMMARY OF THE INVENTION

The present invention relates to an apparatus for monitoring and controlling the amount of granular or powdery material delivered to a conveyor system including a float mechanism for sensing the amount of material in the conveyor tube at a particular point, a mechanism for varying the amount of material being fed into the conveyor system and a mechanism attached to the sensing mechanism and to the inlet feed varying mechanism for controlling the amount of material delivered into the conveyor in response to the sensing mechanism.

The present invention relates to an improved conveyor apparatus for monitoring and controlling the amount of material delivered into a conveyor system.

Another object of the invention is to provide a mechanism for controlling the amount of material being fed into a conveyor system.

A further object of the present invention is to provide a mechanism for preventing an overloading of material into a conveyor system.

Still another object of the present invention is to provide a mechanism for automatically causing a conveyor system to operate at full capacity.

Other objects, advantages and novel features of the present invention will become apparent from the following detailed description of the invention when considered in conjunction with the accompanying drawings.

BRIEF DESCRIPTION OF THE DRAWINGS

FIG. 1 is a perspective view of the present invention;

DESCRIPTION OF THE PREFERRED EMBODIMENT

Figure 2:
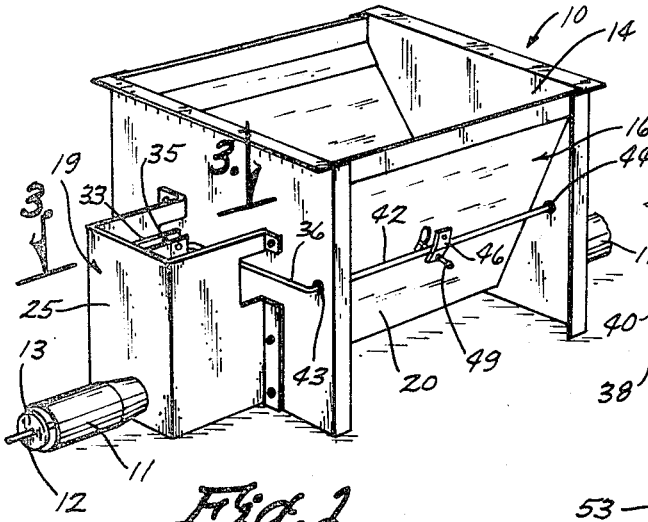
FIG. 2 is an exploded and partial perspective view of the float assembly and controlling mechanism of the present invention.
Figure 2:
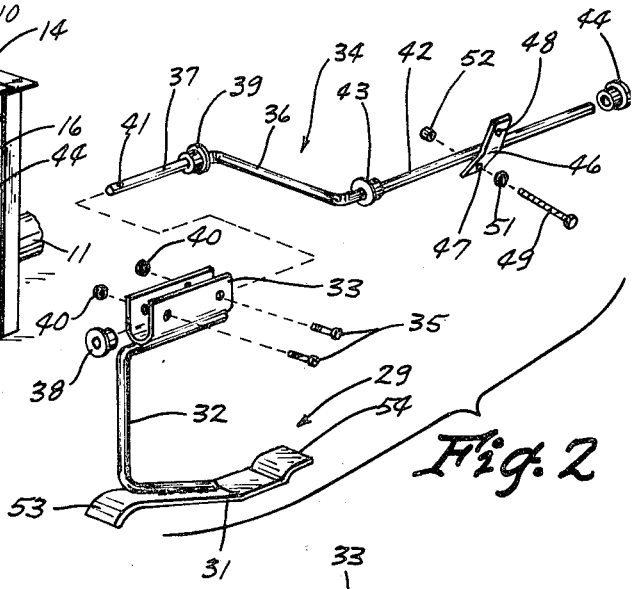
Figure 3:
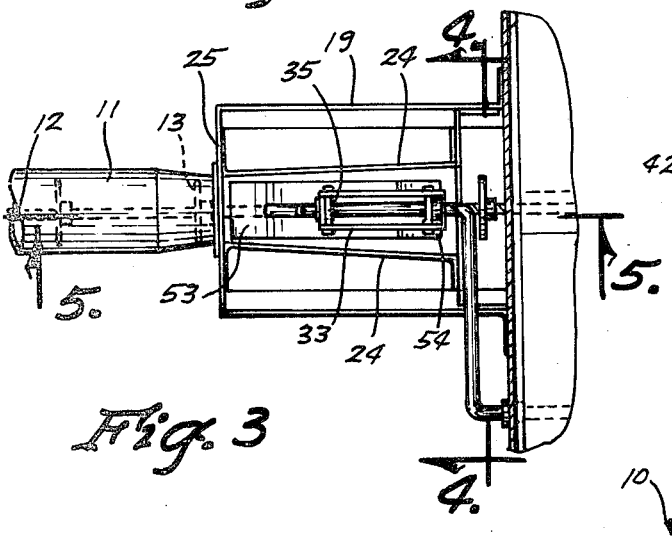
FIG. 3 is a view taken along line 3—3 of FIG. 1.
Figure 4:
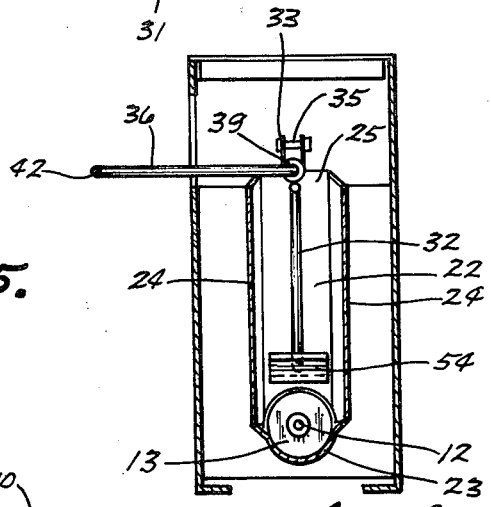
FIG. 4 is a cross-sectional view taken along line 4—4 of FIG. 3.
Figure 5:
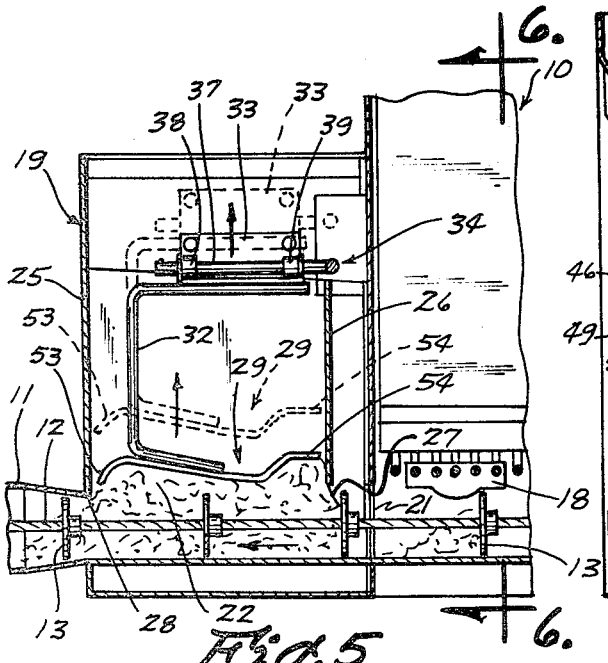
FIG. 5 is a cross-sectional view taken along line 5—5 of FIG. 3.

Referring now to the drawings wherein like reference numerals designate identical or corresponding parts throughout the several views, FIG. 1 shows a perspective view 10 of a preferred embodiment of the present invention. The conveyor system in which the present invention is used in this preferred embodiment includes a tube 11 which forms a circuit and has various material outlet ports (not shown) therein. A continuous flexible member 12 having a plurality of evenly spaced disc members 13 attached thereto is disposed in the tube 11. This flexible member 12 is driven through the tube 11 in order to push material through the tube 11 by a suitable drive apparatus, for example as exemplified by the drive apparatus in U.S. Pat. No. 3,905,473 to Jones et al. Outlet ports (not shown) can be formed for feeding poultry or other animals, for example as shown in U.S. Pat. No. 3,962,996 to Jones et al.

An inlet hopper 14 is attached in the conveyor circuit in order to facilitate adding powdery or granular material to the conveyor tube 11, for example as shown in U.S. Pat. No. 3,971,714, which is incorporated herein by reference.

In order to add material to the conveyor system, it is merely dumped into the top opening of the hopper 14 and this material is delivered to the bottom portion of the hopper 14, having the cable 12 passing therethrough, due to agitation of a material varying mechanism 16 which delivers the material from the main chamber in the hopper when a screen 17 is vibrated due to the discs 13 striking a cam member 18 as is explained in detail in U.S. Pat. No. 3,971,714. A housing 19 is attached to the down stream side of hopper 14 adjacent outlet opening 21 in hopper 14. This housing 19 has a chamber 22 formed therein. This chamber 22 is formed by a bottom wall 23, tapering side walls 24 and end walls 25 and 26. The chamber 22 has an inlet orifice 27 and an outlet orifice 28, which outlet orifice 28 constitutes a restriction, the purpose of which will be explained below.

Figure 6:
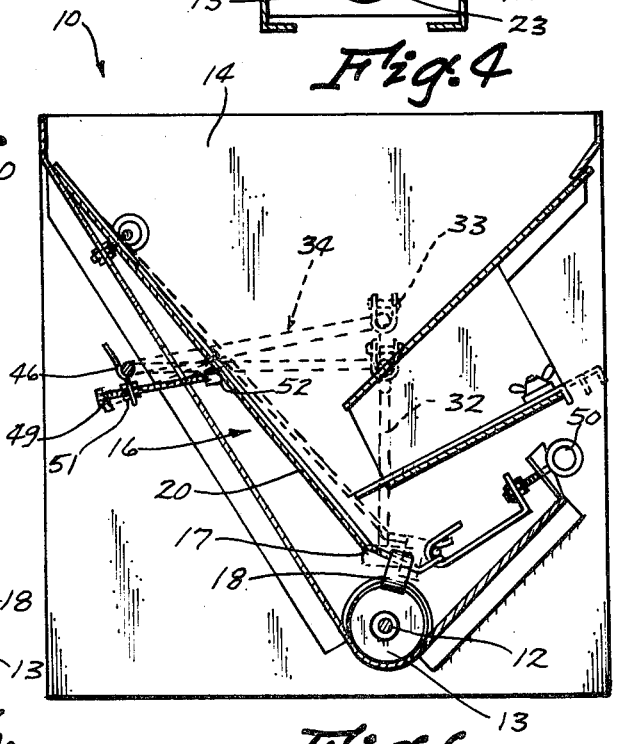
FIG. 6 is a cross-sectional view taken along line 6—6 of FIG. 5.

FIGS. 2–5 clearly show a float assembly 29 have a float member 31 which is welded to a bar member 32. The bar member 32 has a U-shaped member 33 secured to the top thereof, such as by welding, for facilitating a pivotal mounting arrangement to an L-shaped member 34 including link members 36 and 37. The link section 37 extends through the U-shaped member 38 and through bearing members 38 and 39. An opening 41 is formed in the end of section 37 for reception of a pin (not shown) to hold the section 37 from slipping out of the U-shaped member 33. The L-shaped member 34, including link members 36 and 37, are further connected integrally to a rod member 42 which is pivotally attached to the hopper 14 by bearings 43 and 44. A strip of metal 46 is attached rigidly to the rod 42, such as by welding, and a pair of threaded openings 47 and 48 are disposed therein. A threaded projection bolt 49 is threadedly engaged through the opening 47; or, alternatively, nuts 51 and 52 are screwed on to the projection member 49 to hold it in whatever position desired as shown, for example, in FIG. 6. It is to be understood that the opening 48 is not used when the system is set up as shown in FIG. 1, but that it would be used instead of the opening 47 if the flow of the conveyor system were reversed and the housing 19 positioned on the other side of the hopper 14.

In operation, the hopper 14 would be filled with powdery or granular material desired to be conveyed in the conveyor system and the drive unit (not shown) would be activated so as to cause the continuous flexible member 12 to be driven through the tube 11 in a circuit.

Initially, the projection member 49 is set to whatever point is desired so that the cam member 18 is striking the discs 13 to cause the material in the hopper to flow into the conveyor system. This adjustment can also be affected by the threaded member 50 as is fully disclosed in U.S. Pat. No. 3,971,714. Consequently, the material in the hopper 14 will flow out of outlet opening 21, through the orifices 27 and 28 and will continue to fill the tube 11 with material. If the conveyor system begins to return with material in the tube 11 as it reaches the inlet port of the hopper 14, and the hopper 14 continues to deliver the same amounts of material into the conveyor system, then there would be a danger of overloading the system. However, when this excess material enters the chamber 22 below the float member 31, it will be collected there since only a certain amount can pass through the orifice 28. As this material collects in the chamber 22 and the float 31 raises accordingly, for example as shown in dashed lines in FIG. 5, this causes rotation of the rod 42 and, coincidentally, movement of the screen 17 from the position shown in solid lines to the position shown in dashed lines in FIG. 6, because of the abutment of the end of member 49 against the plate 20 attached to the back of the screen 17.

Once the flow of material from the hopper ceases due to the stopping of vibration of the screen 17 (i.e., cam members 18 are not contacting disc members 13), then the disc members 13 will begin to take out the excess material in chamber 22 below the float member 31, and the float member 31 will accordingly drop down by following the top of the material within the chamber 22. This downward movement of the float 31 will, of course, cause a rotating effect on the rod 42 and projection member 49, thereby allowing plate 20, screen 17 and cam projection 18 to lower somewhat. When the cam 18 is lowered enough to contact the disc members 13, screen 17 will vibrate and additional material will be delivered from the hopper 14 into the conveyor system. It can also easily be appreciated that there will be varying amounts of vibration of the screen 17 depending upon the position of the cam member 18 with respect to the discs 13, which is indirectly controlled by the position of the float member 31.

The particular shape of the float member 31 is quite important, noting that the end 53 adjacent the outlet opening 28 extends downwardly so as to direct the material within the chamber 22 accordingly, and this shape also prevents material from going around the end 53 and on top of the float member 31. Also, the other end 54 of the float member 31 extends upwardly so that it will direct all of the material entering through the port 27 downwardly; and, again, not allow this material to go above the float member 31, which would cause the device to malfunction. The clearances between the float member 31 and the sides of the chamber 22 are also somewhat narrow for the purpose of preventing material from getting above the float member 31.

Accordingly, it can be appreciated that the conveyor utilizing this invention can run continuously without overloading the conveyor tube 11. If feed is returning in the conveyor system to the hopper 14, then the float will sense this condition and turn off the flow from the hopper to prevent such overloading of the tube 11. In other instances, the float may only reduce the amount of flow from the hopper, rather than shut it off if only a small portion of material is being returned. Of course, when the conveyor returns in an empty condition, then the hopper device 14 would add material to the conveyor system at a maximum amount, since the float member 31 would be in its downwardmost position for any particular setting of adjusting members 49 and 50.

Obviously many modifications and variations of the present invention are possible in light of the above teachings. It is therefore to be understood that, within the scope of the appended claims, the invention may be practiced otherwise than as specifically described.

I claim:

1. Apparatus for monitoring and controlling the amount of granular or powdered material delivered to a conveyor system of a type including: a circuitous conveyor tube; a continuous flexible member disposed in said tube and having a plurality of spaced disc members rigidly attached thereto; at least one outlet port in said tube for delivering said material to a predetermined destination; a hopper attached to said tube for holding material for selectively delivering said material to said tube, said hopper having an inlet port connected to one end of the tube and an outlet port connected to the other end of the tube; the improvement comprising:

means attached to the outlet port of said hopper for sensing the amount of material in the conveyor tube at such outlet port;

means for varying the amount of material passing from the hopper to the conveyor tube; and means attached to said sensing means and to said varying means for controlling the amount of material delivered to the conveyor tube from the hopper in response to said sensing means, said sensing means including a housing means for forming a chamber above said flexible member said chamber having an inlet and an outlet orifice for said flexible member, said outlet orifice having an internal diameter larger than said discs but substantially smaller than the internal diameter of said tube whereby a restriction is formed, and said sensing means disposed in said chamber for following the top surface of the material in said chamber.

2. Apparatus as defined in claim 1 wherein said chamber is larger at said inlet orifice than at said outlet orifice.

3. Apparatus as defined in claim 1 wherein said sensing means has a downwardly projecting portion adjacent the outlet orifice end thereof.

4. Apparatus as defined in claim 3 wherein said sensing means has an upwardly projecting portion adjacent the inlet orifice end thereof.

5. Apparatus as defined in claim 1 wherein said varying means comprises:

an agitator member extending from said hopper to a point adjacent to said continuous flexible member whereby said agitator member is vibrated when said disc members contact said agitator member thereby causing material to flow from said hopper into said tube.

6. Apparatus as defined in claim 5 wherein said agitator member comprises a screen pivotally attached to said hopper and having a plate section formed thereon, said agitator member further comprising a cam member connected to the bottom of said screen.

7. Apparatus as defined in claim 5 wherein said controlling means comprises a rod pivotally attached to said hopper, projection means attached to said rod for selectively contacting and moving said agitator member from contacting said disc members when said sensing means is in a raised position and selectively allowing said agitator member to contact said disc members when said sensing means is in a lowered position; and means attached to said rod and to said sensing means for causing said rod to pivot in response to movement of said sensing means.

8. Apparatus as defined in claim 7 wherein said means for pivoting the rod in response to movement of the sensing means comprises an L-shaped linkage member pivotally attached to said float and rigidly attached to said rod.

9. Apparatus as defined in claim 7 wherein said projection means is adjustably attached to said rod whereby its position can selectively be changed.

10. Apparatus as defined in claim 6 wherein said screen and cam are disposed generally above said cable and are biased downwardly by gravity towards said cable.

11. Apparatus as defined in claim 10 including means for selectively setting the lowermost position of said cam member.

12. Apparatus for monitoring and controlling the amount of granular or powdered material delivered to a conveyor system of a type including: a circuitous conveyor tube; a continuous flexible member disposed in said tube and having a plurality of spaced disc members rigidly attached thereto; at least one outlet port in said tube for delivering said material to a predetermined destination; a hopper attached to said tube for holding material for selectively delivering said material to said tube, said hopper having an inlet port connected to one end of the tube and an outlet port connected to the other end of the tube; the improvement comprising:

means attached to the outlet port of said hopper for sensing the amount of material in the conveyor tube at such outlet port including an outlet orifice having an internal diameter larger than said discs but substantially smaller than the internal diameter of said tube whereby a restriction is formed;

means for varying the amount of material passing from the hopper to the conveyor tube; and means attached to said sensing means and to said varying means for controlling the amount of material delivered to the conveyor tube from the hopper in response to said sensing means.

* * * * *